US005895278A

United States Patent [19]

Humphrey

[11] Patent Number: 5,895,278

[45] Date of Patent: Apr. 20, 1999

[54] CONTROLLED IMPEDANCE, HIGH DENSITY ELECTRICAL CONNECTOR

[75] Inventor: David T. Humphrey, Collierville, Tenn.

[73] Assignee: Thomas & Betts Corporation, Memphis, Tenn.

[21] Appl. No.: 08/720,903

[22] Filed: Oct. 10, 1996

[51] Int. Cl.[6] ..... H01R 4/66

[52] U.S. Cl. ..... 439/101; 439/67

[58] Field of Search ..... 439/62, 65, 67, 439/77, 101, 108, 492, 493, 495, 496, 499, 260

[56] References Cited

U.S. PATENT DOCUMENTS

| | | | |
|---|---|---|---|
| 4,453,795 | 6/1984 | Moulin | 439/67 |
| 4,659,155 | 4/1987 | Walkup et al. . | |
| 4,674,808 | 6/1987 | Phy | 439/108 |
| 4,747,787 | 5/1988 | Siwinski | 439/108 |
| 4,768,971 | 9/1988 | Simpson | 439/67 |
| 4,806,110 | 2/1989 | Lindeman | 439/108 |
| 4,824,384 | 4/1989 | Nicholas et al. | 439/108 |
| 4,907,975 | 3/1990 | Dranchak et al. | 439/67 |
| 5,040,999 | 8/1991 | Collier | 439/108 |
| 5,163,835 | 11/1992 | Morlion et al. | 439/108 |
| 5,169,324 | 12/1992 | Lemke et al. | 439/101 |
| 5,171,154 | 12/1992 | Cascolti et al. | 439/67 |
| 5,178,560 | 1/1993 | Yaegashi et al. | 439/497 |
| 5,197,902 | 3/1993 | Cesar | 439/77 |
| 5,256,082 | 10/1993 | Yaegashi et al. | 439/497 |
| 5,259,768 | 11/1993 | Brunker et al. | 439/60 |
| 5,263,870 | 11/1993 | Billman et al. | 439/108 |
| 5,342,208 | 8/1994 | Kobayashi et al. | 439/629 |
| 5,413,491 | 5/1995 | Noschese | 439/108 |
| 5,507,651 | 4/1996 | Tanaka et al. | 439/67 |
| 5,531,615 | 7/1996 | Irlbeck et al. | 439/631 |

OTHER PUBLICATIONS

Augat Catalog entitled "Connector Products . . . ", undated, only pp. 68,69.

*Electronic Products*, "Patented contact yields high interconnection density", May 1996.

*Primary Examiner*—Gary Paumen
*Assistant Examiner*—Tho Dac Ta
*Attorney, Agent, or Firm*—Hoffmann, & Baron, LLP

[57] ABSTRACT

The electrical connector assembly includes a female connector portion which is mountable to a first printed circuit board, such as a motherboard, and a male connector portion which is mechanically and electrically connected to a second printed circuit board, such as a daughterboard. The female connector portion includes a plurality of signal contacts arranged in two rows having a ground terminal, or conductive elastomer, positioned between the rows of signal contacts. The male connector portion preferably includes a flexible circuit having a solid groundplane separated by an dielectric insulator from an electrical trace thereon. The distance separating the groundplane from the trace and the width of the trace controls a characteristic impedance of the flexible circuit for matching to specific circuit requirements of the daughterboard and motherboard. Upon mechanical connection of the male connector portion to the female connector portion, the signal contacts electrically engage the trace on the flexible circuit and the groundplane electrically engages the ground terminal. The specific design of the connector assembly provides a controlled impedance, high signal contact density connector having reduced cross-talk and enhanced signal transmission, even at ultra high (UHF) signal transmission speeds.

26 Claims, 15 Drawing Sheets

CONTROLLED IMPEDANCE, HIGH DENSITY ELECTRICAL CONNECTOR

BACKGROUND OF THE INVENTION

1. Field of the Invention

The present invention relates to electrical connectors generally, and more particularly to an electrical connector having a controlled impedance and a high density of signal contacts by using a groundplane in proximity to the signal contracts.

2. Description of the Prior Art

Conventional types of connectors have been used heretofore for connection of circuits on motherboards and daughterboards, in computer equipment or in similar applications, and they have generally been reliable in operation. However, there have been problems and in the last few years they have been increasing in magnitude, especially when contact spacings are reduced, to reduce the sizes of connectors and/or to increase the number of contacts, or when the interconnected circuits are designed to use advances in technology which make it possible to transmit large volumes of data at high speeds. Such problems have included loss of transmitted signals, interference between signals or "cross-talk" and interference from extraneous signals. The existence of such increasing problems have been generally recognized, but satisfactory solutions have not been apparent.

Some of these problems have been attributed to poor ground connections. For example, ground connectors tend to develop electrostatic charges when high volumes of signals are transmitted at high speeds. A shift in voltage between groundplanes of two interconnected circuits may result in loss of reference levels in electronic circuitry. Mismatched impedances between circuitry and connectors causes reflections and the production of undesirable standing wave phenomena, with corresponding errors in transmitting data, in the case of transmitting data signals. It has also been recognized that cross-talk between signal paths increases with frequency and with decreases in spacing between signal contacts. This problem is affected to a substantial extent by the characteristics of the ground connection which is common to the signal paths.

Typically, one or more connector pins have been used in the past for ground connections and, in some cases, each pin used for signal transmission may have an associated adjacent pin used for a ground connection, in an attempt to minimize cross-talk problems. It has been found that this does not provide an adequate solution because there may nevertheless be substantial impedances in the ground connections and also, this solution requires many more connector pins. Moreover, if the number of ground pins were increased so as to use two or more pins for each signal pin, it would impose severe space limitations, increase insertion forces, and provide a less continuous shielding field than a groundplane.

Another problem with prior constructions relates to the impedance characteristics of the signal paths. Each signal path of an electrical connector, with conductor length greater than 0.05 times wavelength, may be considered as an electrical transmission line having a certain characteristic impedance determined by its resistance, inductance, and distributed capacitance per unit length. At relatively low signal transmission velocities with associated lower frequency and longer wavelength, the actual impedance of the path is not usually important. However, at high velocities, the path may produce reflections, resonances and standing wave phenomena when there is a substantial mismatch between the characteristic impedances of the circuits connected thereto. It has also been observed that it is especially desirable that the characteristic impedances of all paths be substantially the same within a given circuit path, and targeted to the characteristic impedance of the logic type used, so as to facilitate design of the connected circuits.

Such impedance characteristics of an electrical connector may also affect different types of circuits in different ways. For example, some systems use mixed logic such as emitter coupled logic (ECL), transistor to transistor logic (TTL) and/or complimentary metal oxide semiconductor (CMOS) logic. Each of these logic circuits perform best at different target system characteristic impedances. Thus, it would be beneficial to provide an electrical connector capable of closely controlling characteristic impedances to match the different logic sections of a printed circuit board. To date, no such connectors are available which meet this entire list of needs.

OBJECTS AND SUMMARY OF THE INVENTION

It is an object of the present invention to provide an electrical connector wherein the characteristic impedance can be closely controlled to match a system impedance.

It is a further object of the present invention to provide an electrical connector including a groundplane such that the characteristic impedance of the connector can be controlled by controlling the distance of the groundplane from the connector signal contacts.

It is another object of the present invention to provide an electrical connector which is modular in design wherein the characteristic impedance associated with each modular portion of the connector may be controlled to a target value without the need for retooling the entire connector assembly.

It is still a further object of the present invention to provide an electrical connector wherein the characteristic impedance of the connector can be varied over the length of the connector so that several different characteristic impedances are available from one end of the connector to the other end of the connector.

It is yet another object of the present invention to provide an electrical connector having a closely controlled characteristic impedance while providing a high density of signal contacts.

It is yet another object of the present invention to provide an electrical connector having a flexible circuit, the flexible circuit, or flex strip, or planar cable, including a groundplane on one side and an electrical signal trace on the other side, the characteristic impedance of the flexible circuit being dependent upon the distance from the groundplane to the signal trace and the width of the signal trace. This microstrip could be substituted with a stripline structure having two or more groundplanes.

It is still another object of the present invention to provide an electrical connector for coupling a daughterboard to a motherboard, the electrical connector including a flexible circuit, however named, to control the characteristic impedance of the connector.

It is a further object of the present invention to provide an electrical connector for coupling a daughterboard to a motherboard, the electrical connector separating the functions of mechanical and electrical connections so that the electrical impedance can be varied independently to the mechanical properties, and the connector modules in the frame could "float" or move independently from the daughtercard.

It is still another object of the present invention to provide an electrical connector having a flexible circuit including a groundplane and signal contacts, wherein the artwork or signal trace of the flexible circuit may take any desired configuration, e.g., first mate, last break contacts or bused connections.

It is an object of the present invention to provide an electrical connector having controlled characteristic impedance, a high density of signal contacts and can operate in the 200 MHZ–1 GHz region without cross-talk and impedance mismatch.

In accordance with one form of the present invention, an impedance controlled, high density electrical connector comprises a female connector portion including a plurality of electrical signal contacts. Each of the signal contacts includes a termination end for electrically coupling the female connector portion to a printed circuit board, such as a motherboard and an opposite connecting end. The electrical connector further includes a plug assembly or male connector portion having at least one flexible circuit mounted therein. The at least one flexible circuit includes a groundplane and an electrical trace thereon. The groundplane and electrical trace are separated by a predetermined distance via a dielectric material. The predetermined distance separating the groundplane from the electrical trace controls a characteristic impedance associated with the flexible circuit. The electrical trace includes first contact portions for electrical engagement with the connection end of the electrical contacts in the female connector portion and second contact portions for electrical engagement with a second printed circuit board, such as a daughterboard. The first and second contact portions are electrically coupled by the electrical trace. The groundplane of the flexible circuit is connectable to a system ground on the motherboard when the male connector portion is mechanically connected to the female connector portion thereby electrically connecting the motherboard to the daughterboard.

Each of the male connector portion and female connector portion may include a plurality of modular sections provided therein. More specifically, the female connector portion may include a plurality of modular receptacles and the male connector portion may include a plurality of male module portions. Each male module portion includes a flexible circuit as described above. Each of the female receptacle modules includes the plurality of electrical contacts provided therein. Preferably, the female module receptacle includes at least two rows of electrical signals provided therein and either a groundplane strip connector or elastomeric ground connector positioned between the at least two rows of electrical contacts for electrically engaging a ground pad on a motherboard.

The flexible circuit of the male connector portion may include a first side and a second side such that the characteristic impedance of the flexible circuit may be varied from the first side to the second side by changing the predetermined distance separating the groundplane from the electrical trace along the flexible circuit or the width of the signal trace. Accordingly, a characteristic impedance associated with signal contacts on one side of the flexible circuit may be different from signal contacts associated with a second side of the flexible circuit. Additionally, the flexible circuit preferably is formed from a laminate having the groundplane at a bottom portion thereof, a dielectric base provided above the groundplane and the electrical trace being formed on the top surface of the dielectric base. The groundplane may extend through the dielectric base to a top surface of the flexible circuit by through-hole plating to form a groundplane contact pad on the same side of the flexible circuit as the electrical trace. Additionally, the male connector portion of the electrical connector may include a paddle-like body made of a dielectric insulator on which the flexible circuit is bent around so that the plurality of second contact portion of the electrical trace are on opposite sides of the body to be electrically coupled to the two rows of signal contacts within the female connector portion of the connector assembly.

The male connector portion of the connector assembly is designed so that the flexible circuit may be electrically connected to a single side of a double-sided printed circuit board. Accordingly, a connector assembly including a plurality of modules may be arranged so that some modules are connected to one side of the double-sided printed circuit board while other modules are connected to the opposite side of the printed circuit board.

The plurality of electrical signal contacts housed within the female portion of the electrical connector assembly are preferably spring-type separable contacts. Signal contacts are gold plated to enhance signal transmission reliability. It is understood that the motherboard and daughterboards may be any signal source/receiver and that the electrical connector assembly of the present invention may transmit signals to and from a first and second signal source/receiver.

In an alternative embodiment, the male connector portion does not utilize a flexible circuit, but rather uses a modular male connector having a substantially U-shaped insulative body. The insulative body includes a plurality of signal contacts located on opposite outside legs of the body and an elongate groundplane terminal positioned between the legs of the body. Upon mechanically connecting the male connector portion to the female connector portion, the electrical signal contacts of the female connector portion electrical engage the signal contacts of the male connector portion and the ground place terminal is electrically engaged with the ground terminal of the female connector portion. Similar to the predetermined distance separating the electrical trace from the groundplane on the flexible circuit, the characteristic impedance of the connector assembly in the alternative embodiment may be varied by changing the material and thickness forming the groundplane in the male connector portion. The body of the module may include a conductive shield to aid in preventing interference within the connector.

The connector assembly of the present invention may also include a jackscrew arrangement for mechanically connecting the male connector portion to the female connector portion. The jackscrew arrangement may include a jackscrew having a slot formed therein and a substantially U-shaped retainer clip which rides within the slot.

The connector assembly of the present invention provides an electrical connector having a controlled impedance and a high signal contact density with reduced cross-talk and enhanced signal transmission, even at ultra high frequency (UHF) signal transmission speeds. The characteristic impedance of the connector assembly may be easily changed without modifications to the manufacturing or tooling of the connector assembly. Simply by changing the flexible circuit or groundplane contact in the male connector portion of the connector assembly, the characteristic impedance can be specifically chosen to match any circuit specifications.

A preferred form of the electrical connector, as well as other embodiments, objects, features and advantages of this invention, will be readily apparent from the following detailed description of illustrative embodiments thereof, which is to be read in connection with the accompanying drawings.

DETAILED DESCRIPTION OF THE PREFERRED EMBODIMENTS

Figure 1:
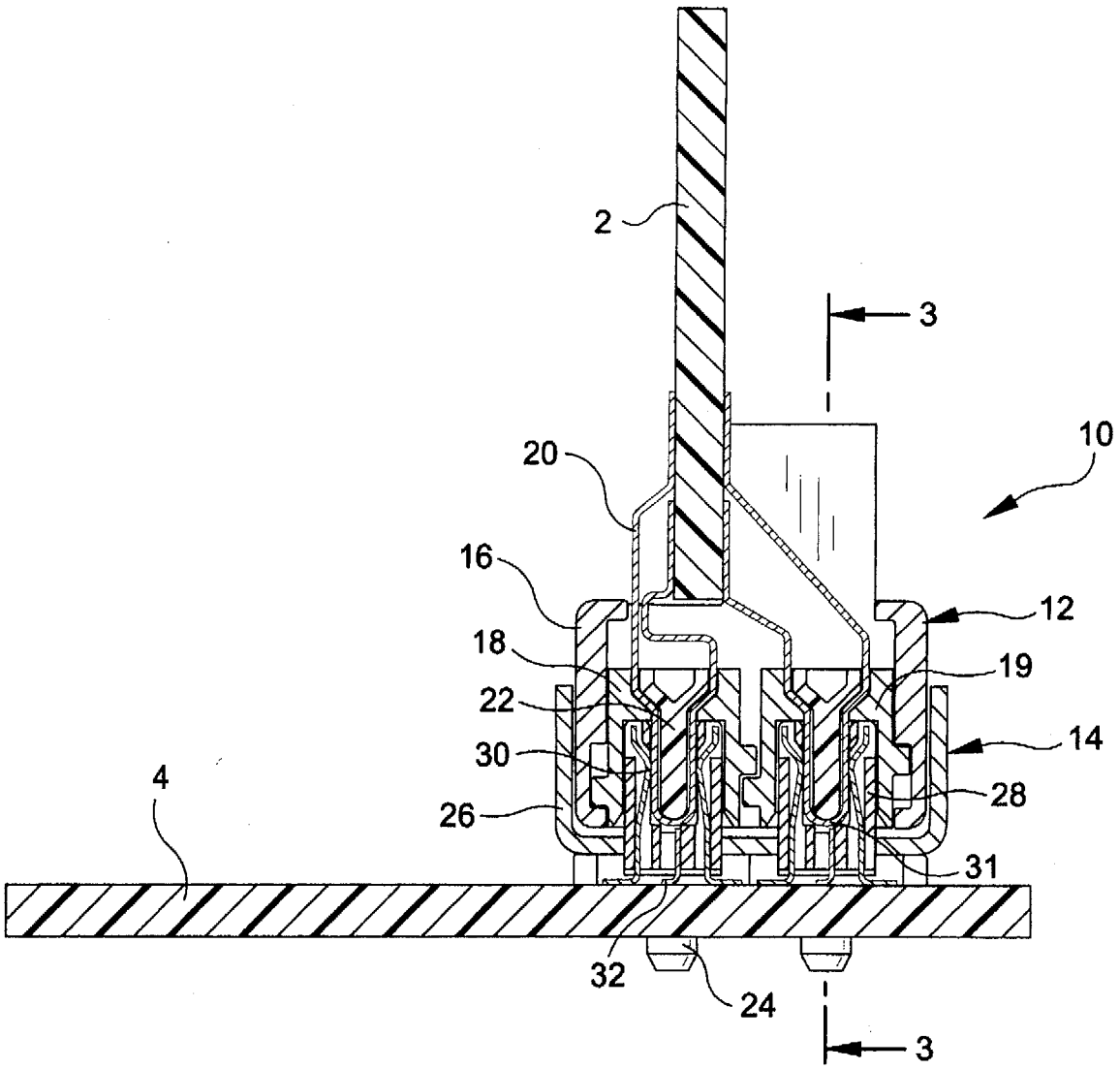
FIG. 1 is a cross-sectional view taken through two of the modular connector sections of the electrical connector assembly shown in FIG. 2.
Figure 2:
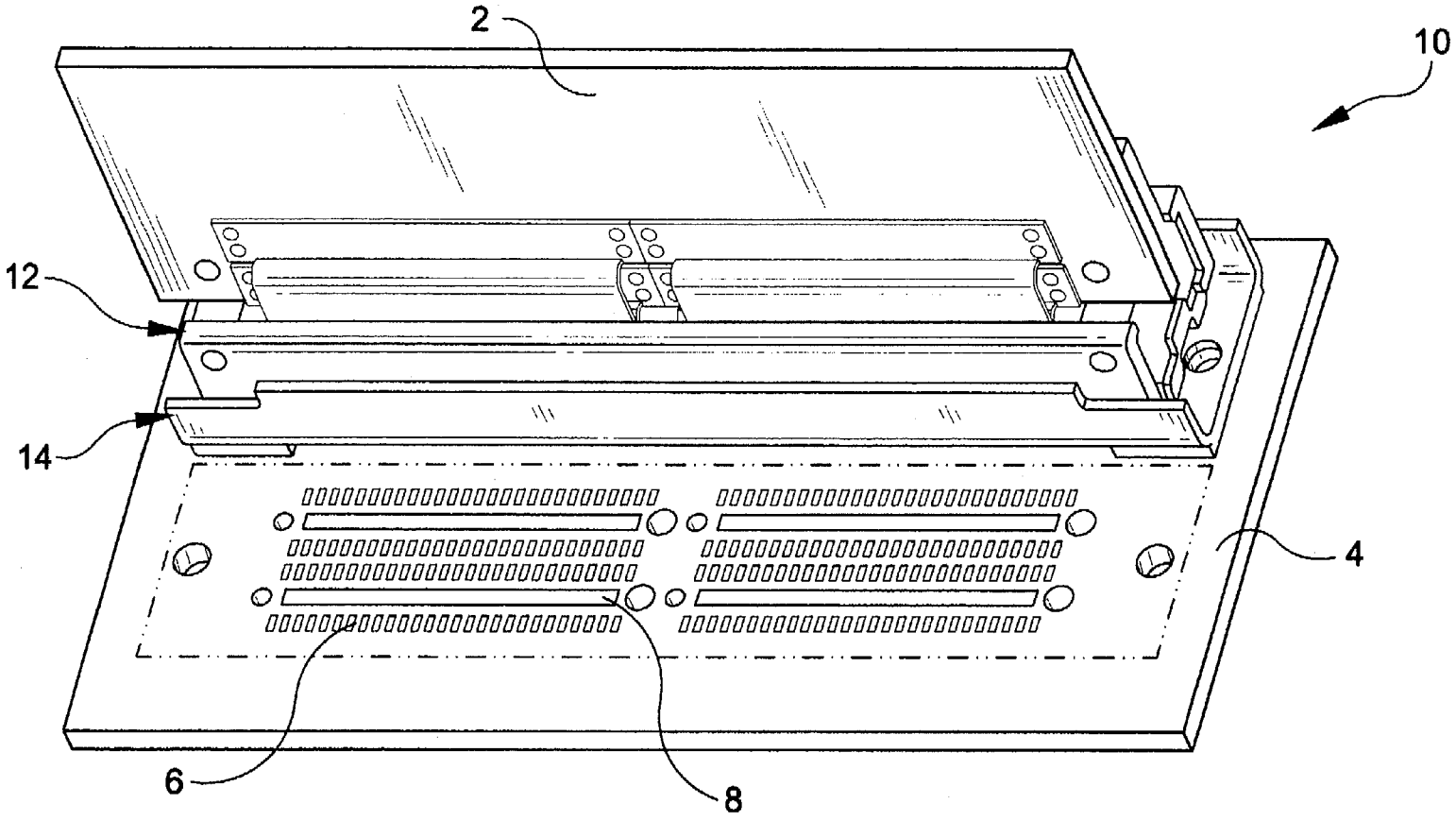
FIG. 2 is a perspective view of the entire electrical connector assembly formed in accordance with the present invention coupling a daughterboard to a motherboard.

FIG. 1 is a cross-sectional view of the connector assembly shown in FIG. 2 taken through two of the connector modules of the electrical connector assembly. As illustrated in FIG. 1, the male connector portion 12 includes a plug assembly 16 having positioned therein a plurality of modules. In particular as shown in FIG. 1, two modules 18, 19 are illustrated. Each module 18, 19 includes a flexible circuit 20 which is wrapped around a module center paddle 22, the paddle preferably being made from a dielectric material. The ends of the flexible circuit are configured to be electrically and mechanically connected to the daughterboard. More specifically, signal and ground contact pads on the flexible circuit 20 are soldered to signal and ground contacts on the daughterboard 2. Depending upon the application, the ends of the flexible circuit may either be mounted to opposite sides of the daughterboard or, as shown in the preferred embodiment in FIG. 1, both ends of the flexible circuit 20 are connected to a single side of the double-sided daughterboard 2.

The female connector portion 14 includes a plurality of mounting dowel pins 24 which are mounted in holes extending through the thickness of the motherboard 4. Additionally, the female connector portion 14 includes a frame 26 having mounted therein a plurality of female module receptacles 28. Each module receptacle 28 includes a plurality of signal contacts 30 having a first end electrically connected to the signal contact pads 6 located on the surface of the motherboard 4. A second end of the signal contacts includes a spring-type retention portion which electrically connects the signal contact pads on the motherboard 4 to the signal contact pads positioned on the flexible circuit 20. Preferably, the first end of the signal contacts are soldered to the contact pads on the motherboard. Also shown in FIG. 2 is the groundplane terminal strip connector 32 having a first end electrically connected to a ground contact pad 8 on the motherboard and a second end electrically connected to the groundplane contact pad 41 located on the flexible circuit 20.

Referring to FIG. 2, the present invention is a controlled impedance, high density electrical connector 10 for connecting two printed circuit boards, namely, a daughterboard 2 to a motherboard 4. The motherboard 4 includes a series of signal contact pads 6 thereon as well as a plurality of elongated ground contact pads 8. The electrical connector assembly 10 includes a male connector portion 12 which is electrically and mechanically coupled to the daughterboard 2 and a female connector portion 14 which is mechanically and electrically connected to the motherboard 4. It will be understood by those skilled in the art that the female and male connector portions of the connector assembly formed in accordance with the present invention and the novel features thereof may be used in other configurations to accomplish similar purposes.

Figure 3:
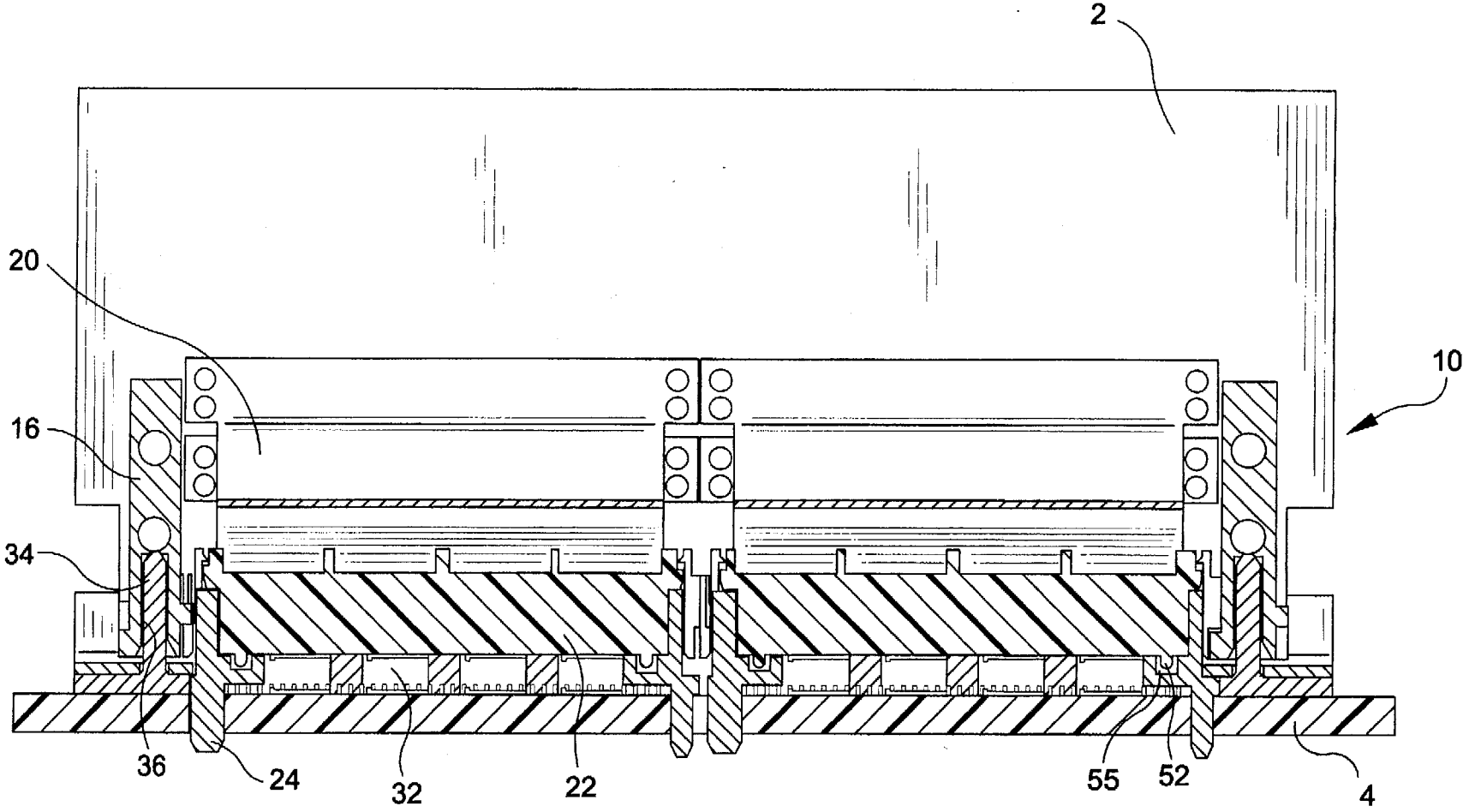
FIG. 3 is a longitudinal cross-sectional view of the electrical connector assembly taken along line 3—3 of FIG. 1.

FIG. 3 is a longitudinal cross-section of the connector assembly 10 taken through line 3—3 in FIG. 2. The female connector portion 14 includes a pair of guide projections 34 at opposite longitudinal ends thereof. The male connector portion 12 includes a mating recess 36 for aligning and interengaging with the guide projections 34. The guide projection 34 and mating recess 36 provides a means for mechanically aligning and connecting the male connector portion 12 to the female connector portion 14. Additionally, FIG. 3 illustrates an embodiment of the present invention in which a plurality of flexible circuits 20 are attached to a single side of the daughterboard.

Figure 4:
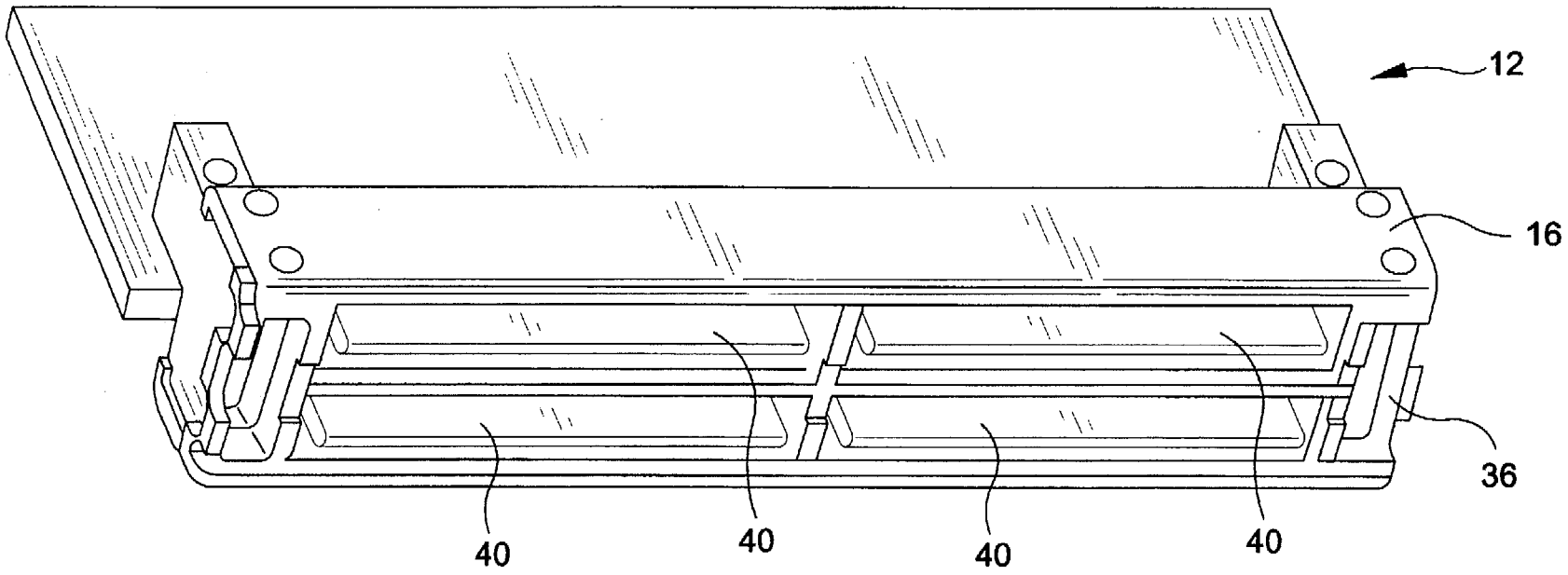
FIG. 4 is a perspective view of the daughterboard male connector portion of the electrical connector assembly formed in accordance with the present invention.

FIG. 4 is a perspective view of the male connector portion 12 of the electrical connector assembly 10 of the present invention. In the embodiment shown in FIG. 4, the male connector portion includes four individual modules 40. Each individual module 40 includes its own flexible circuit 20 mounted therein. Since the impedance of the connector may be closely controlled by controlling the impedance of the flexible circuit 20, the connector assembly 10 may include four, or more if required, different modules having different characteristic impedances to match specific circuits on the mother and daughterboards varied independently from mechanical contact forces. Alternatively, the connector assembly may be provided with a power system module for carrying power needs of printed circuit boards to which the connector assembly couples. Additionally, the plug assembly 16 of the male connector portion provides the mechanical connection of the connector modules to the daughterboard. Thus, the mechanical and electrical connections are separated in the connector assembly such that the plug of the male connector portion could float locationally with respect to the daughtercard flexible circuit would form the electrical connections. Furthermore, the electrical connector assembly of the present invention permits a high density of signal contacts to be arranged in a small connector assembly. For example, each connector module may include eighty or more signal contacts therein.

Figure 5A:
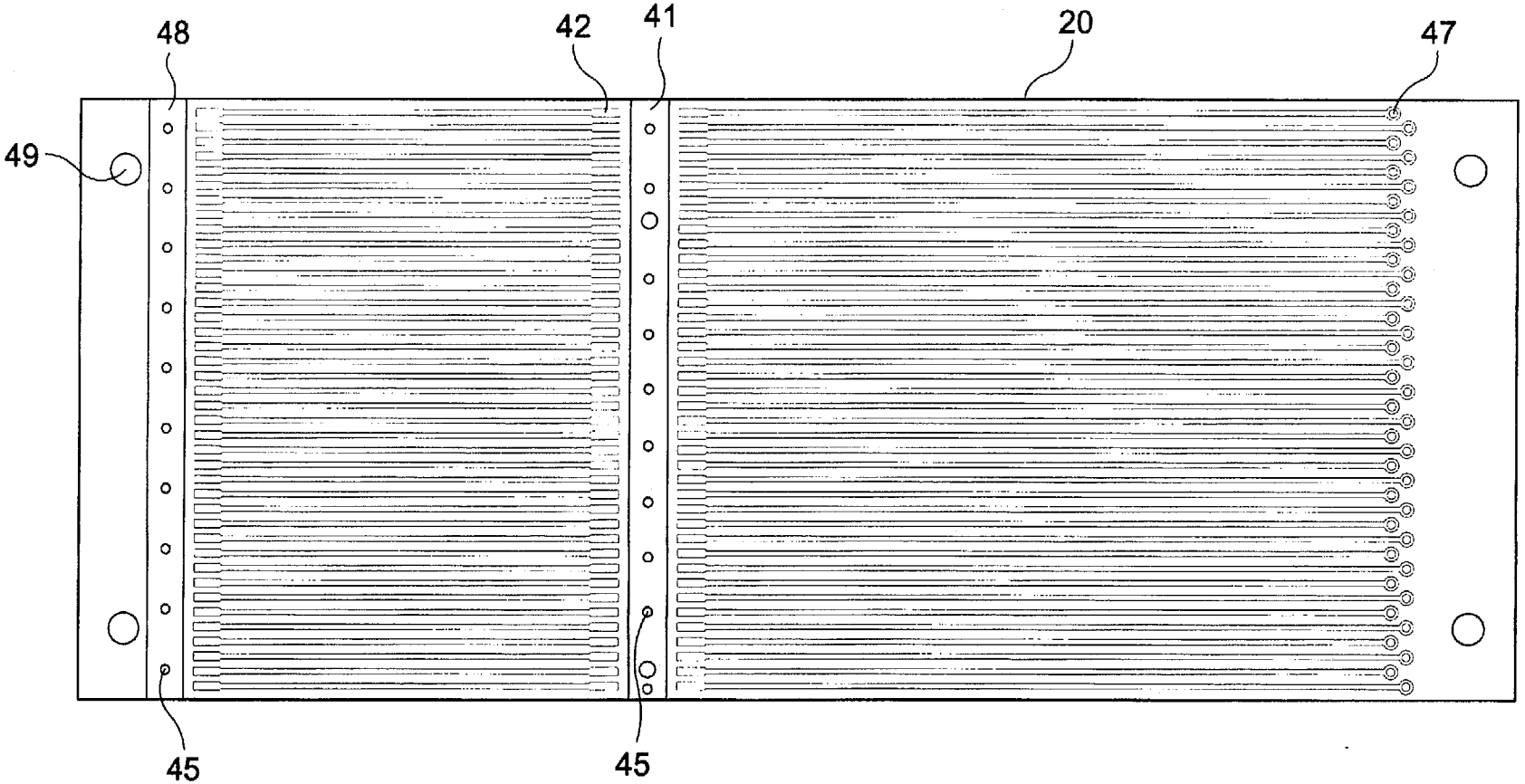
FIG. 5A is a top plan view of the flexible circuit which forms a part of the daughterboard male connector portion of the electrical connector assembly formed in accordance with the present invention.
Figure 5B:
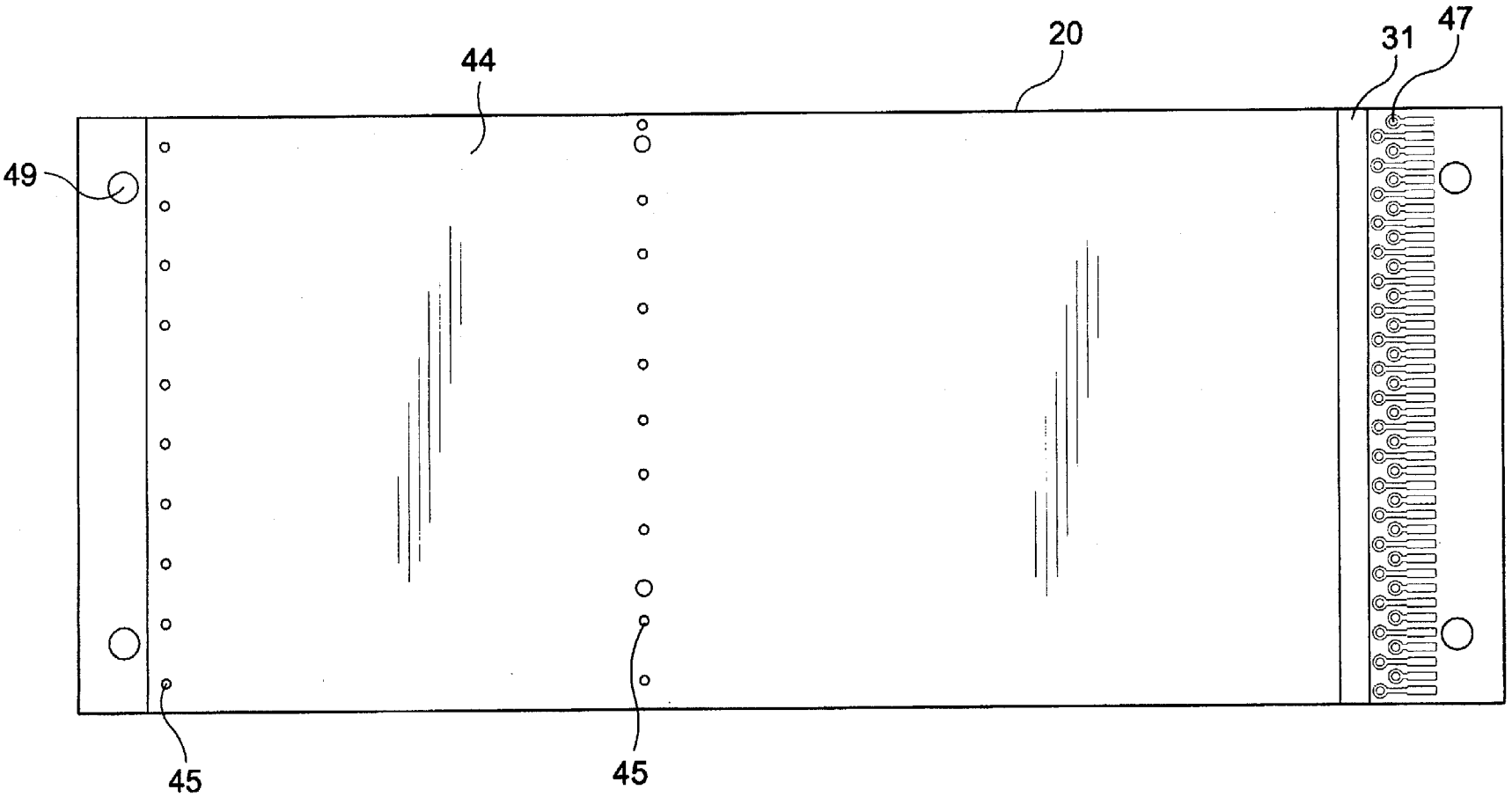
FIG. 5B is a top plan view of the reverse side of the flexible circuit illustrated in FIG. 5A.

FIGS. 5A and 5B are top plan views of the flexible circuit 20 formed in accordance with the present invention. As shown in FIG. 5A, the flexible circuit 20 includes a plurality of signal contact pads 42 having associated electrical traces on the flexible circuit. The flexible circuit 20 further includes a groundplane 44 and groundplane connector contact pads 31, 41, 48. More specifically, the groundplane 44 is formed on a bottom portion of the flexible circuit 20 as shown in FIG. 5B. The groundplane 44 as shown in FIG. 5B is electrically coupled to the groundplane contact pads 41, 48 shown in FIG. 5A via plated through holes 45. Similarly, the signal traces illustrated on the right-hand portion of FIG. 5A are electrically connected to the signal contact pads 51 via plated through holes 47. The second groundplane contact pad 48 shown in FIG. 5A is electrically connected to a ground contact pad (not shown) located on the daughterboard 2 when the flexible circuit 20 is mounted in the male connector portion 12. The groundplane contact pad 41 is electrically connected to the groundplane terminal strip connector 32 (FIG. 2) to electrically couple the groundplane of the flexible circuit to the ground contact pad 8 of the motherboard.

Figure 5C:
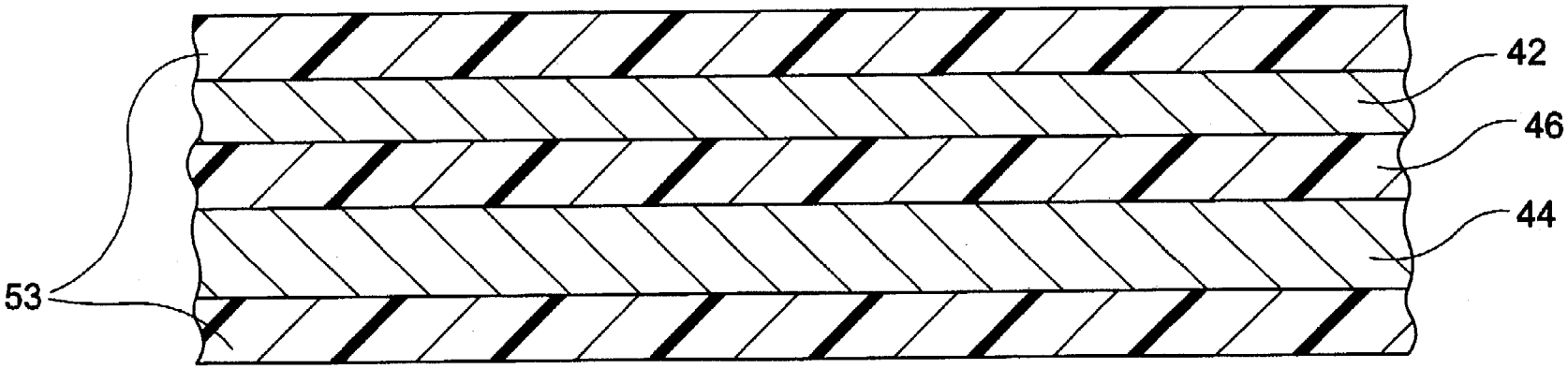
FIG. 5C is a cross-sectional view of the flexible circuit illustrated in FIG. 5A.

FIG. 5C is a cross-sectional view of the flexible circuit 20 illustrated in FIG. 5A. The base and cover layers 53 of the flexible circuit are preferably made of an dielectric material, such as Kapton®. The groundplane 44 is a solid or mesh groundplane made of a conductive material, such as copper. The signal trace 42 is also formed from a conductive material, such as copper. The signal trace 42 may be formed by providing a solid copper plane and etching away copper with acid to create the signal paths. It will be understood by those killed in the art that the artwork of the electrical may take any form. The characteristic impedance of the flex circuit 20 may be specifically tailored to any desired impedance by controlling the distance separating the groundplane 44 from the signal contacts 42, i.e., the thickness of the base 46, as well as the width of the signal traces 42. Accordingly, the electrical performance of the connector, which mainly consists of the essentially flexible circuit, may be used in designing the overall electrical circuit from the early stages in the design. Furthermore, the characteristic impedance of the connector can be closely controlled to a target value within a range of values by merely changing the flexible circuit 20 within a specific module of the connector without connector design modifications or tooling changes.

Since the width of the signal trace may be varied over the length of the flexible circuit 20, it is possible to create a connector having a different characteristic impedance for some of the connector signal traces with respect to other signal traces in the same connector module. Alternatively, each module in the electrical connector assembly may include a flexible circuit having a characteristic impedance different from the other modules to specifically match impedance with a circuit on the daughterboard and motherboard.

The flexible circuit 20 as shown in FIGS. 5A and 5B also includes registration holes 49 for mechanically mating the flexible circuit to the daughterboard 2. In order to mount the flexible circuit 20 to a single side of the daughterboard 2, the groundplane terminal strip 41 is positioned slightly off center and, the longer portion of the signal traces are electrically coupled to the signal contact pads 51 on an opposite side of the flexible circuit via through hole plating 47 so that the signal pad contacts can be mounted to a single side of the double-sided daughterboard as shown in FIG. 6.

It will be appreciated by those skilled in the art that the groundplane may also be used to carry a power voltage, such as a DC reference voltage having a current of less than 5.0 amps. Alternatively, the groundplane may also be used for the transmission of on-off control voltages.

Figure 6:
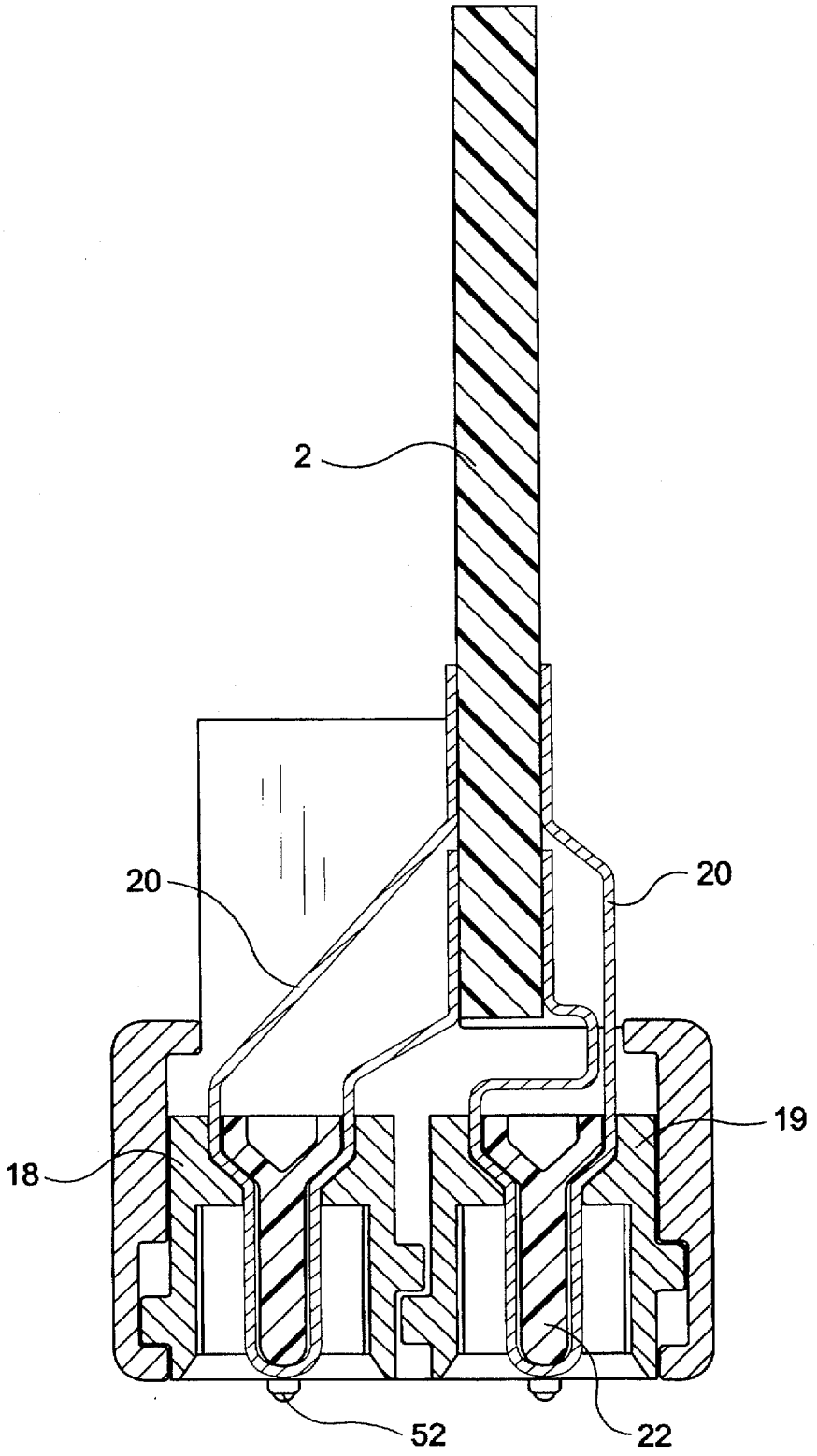
FIG. 6 is a cross-sectional view taken through two of the modular connector sections of the male connector portion of the electrical connector assembly formed in accordance with the present invention.

FIG. 6 is a cross-sectional view of the male connector portion 12 of the electrical connector assembly formed in accordance with the present invention. As clearly shown in FIG. 6, the male connector paddle portion 22 includes a pair of projections 52 thereon. These projections 52 are in the form of circular dowel pins which, when the male connector portion 12 is mated with the female connector portion 14 fits in recesses 55 (FIG. 3) within the female connector portion to aid in the mechanical connection between the female and male connector portions. Additionally, as shown in FIG. 6, the flexible circuit 20 associated with each module 18, 19, respectively, is connected to a single side of the daughterboard 2. In this way, a double-sided daughterboard may be electrically connected to corresponding circuitry located on the motherboard. This arrangement maximizes space available for the circuits. The flexible circuit 20 may be electrically coupled to the daughterboard by soldering the contact pads thereto. Alternatively, the flexible circuits 20 may include contact pins at the connection end to the daughterboard for through-hole mounting thereto. The flexible circuit 20 directly electrically connects the daughterboard to the motherboard, reducing the amount of connections and joints to permit improved signal transmission and reliability through the connector assembly.

Figure 7:
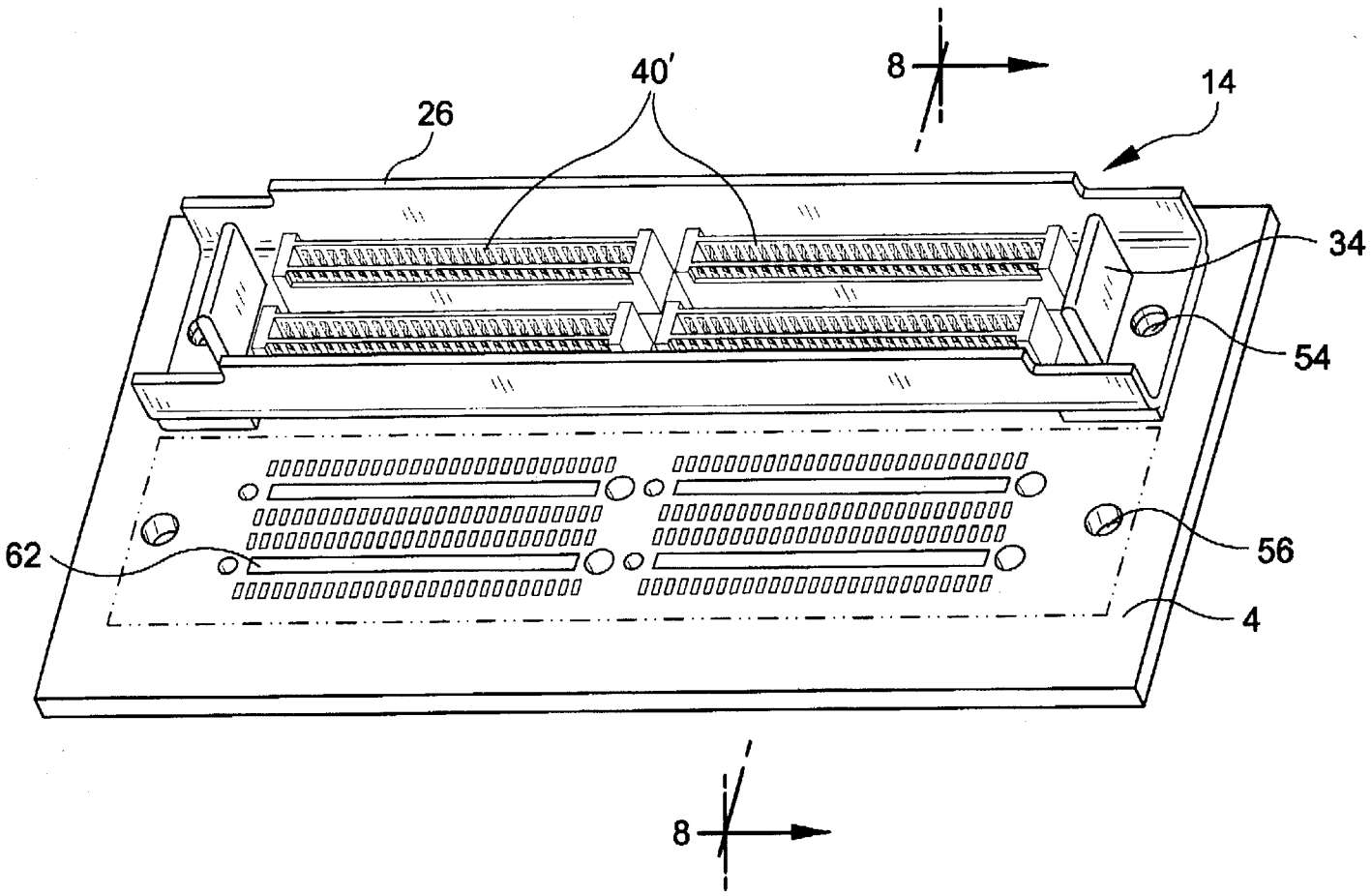
FIG. 7 is a perspective view of the motherboard and motherboard female connector portion of the electrical connector assembly formed in accordance with the present invention.

FIG. 7 is a perspective view of the female connector portion 14 of the connector assembly mounted on the motherboard 4. Although the female connector portion 14 is illustrated as a surface mount connector, it is envisioned that the female connector portion may be a through-hole pin, press-fit tails or an edge-type straddle connector as well. The connector assembly 10 may also be soldered or pressure surface mounted to either the motherboard or daughterboard. The female connector portion 14 includes four modules 40 shown therein. It is to be understood that the electrical connector assembly may include any number of modules as required by the design. In the embodiment shown in FIG. 7, the motherboard 4 and female connector portion 14 each include mounting holes 54, 56 therein so that the female connector portion may be mechanically mounted to the motherboard. Alternatively, the connector assembly may include a jackscrew-type arrangement for mechanically coupling the connector assembly to the motherboard. As previously illustrated in FIG. 4, the female connector portion 14 includes a pair of guide projections 34 for aligning and mechanically connecting the male connector portion 12 to the female connector portion 14 of the connector assembly. Furthermore, it will be understood by those skilled in the art that the connector assembly of the present invention may be used in conjunction with parallel mount mezzanine granddaughter cards in addition to or instead of orthogonally mounted daughterboard applications.

Figure 8:
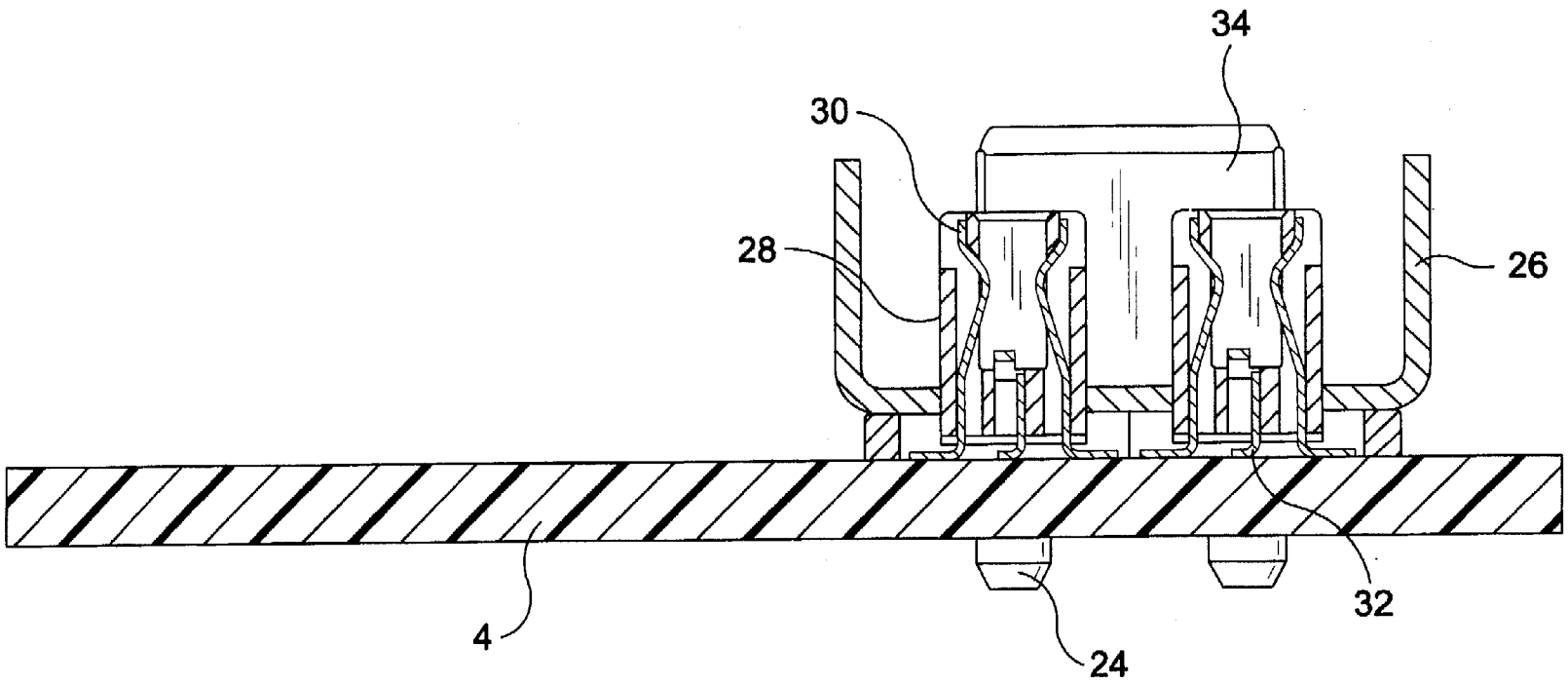
FIG. 8 is a cross-sectional view of the motherboard and motherboard female connector portion taken through two of the modular connector sections of the electrical connector assembly formed in accordance with the present invention.

FIG. 8 is a cross-sectional view taken through the female connector portion 14 shown in FIG. 7. The female connector portion 14 includes a plurality of spring-type separable signal contacts 30 which are arranged in two rows to receive the portion of the which is fitted around the dielectric insulator 22 of the male connector portion 12 shown in FIG. 6. A row of signal contacts 30 are located on both sides of the female contact module receptacles 28 for electrically connecting a signal contact to a signal trace connector pad 42 (FIG. 5A) located on each side of the flexible circuit 20 in the male connector portion. In the embodiment shown in FIGS. 7, 8 and 10, each female connector module receptacle 28 includes eighty signal contacts, forty signal contacts on each side of each module receptacle. The female connector portion 14 also includes therein the groundplane terminal strip connector 32 which is shown in greater detail in FIGS. 9 and 10.

Figure 9:
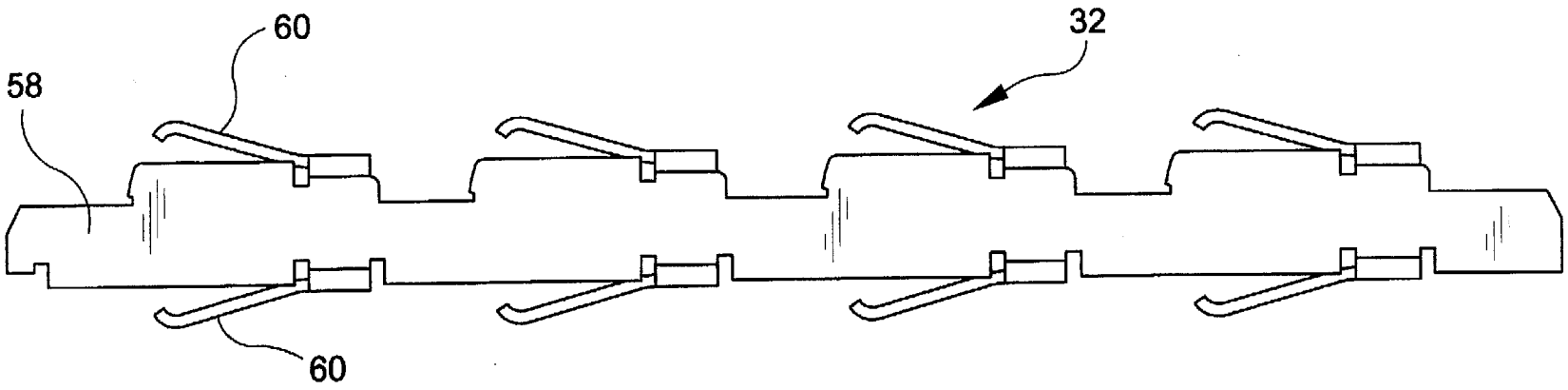
FIG. 9 is a side plan view of the groundplane terminal strip connector of the electrical connector assembly formed in accordance with the present invention.

Referring to FIG. 9, the groundplane terminal strip connector 32 includes an elongate body 58 having cantilevered contact arms 60 connected thereto. When the female connector portion 12 is mounted on the motherboard, each of the groundplane terminal connector strip cantilevered contacts 60 on the bottom portion thereof are electrically connected to a ground contact pad 62 (FIG. 7) on the motherboard. Likewise, the upper cantilevered contacts of the groundplane terminal strip connector are electrically connected to the groundplane contact pad 41 (FIG. 5*a*) when the male connector portion is mechanically connected to the female connector portion. Additionally, the lower end of the spring retention contacts 30 is electrically connected to a solder pad on the motherboard when the female connector portion is mounted thereon. The connections of the female connector portion to the motherboard may be soldered to provide good electrical contact between the connector and motherboard.

Figure 10:
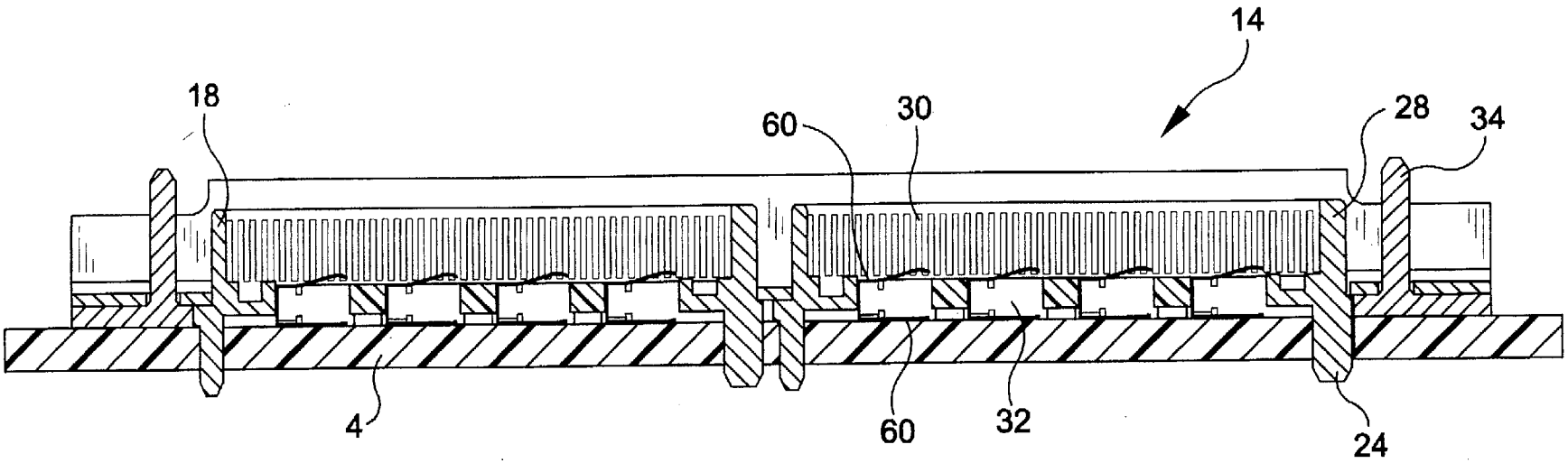
FIG. 10 is a longitudinal cross-sectional view of the motherboard and motherboard connector portion of the electrical connector assembly formed in accordance with the present invention.

FIG. 10 is a longitudinal cross-sectional view of the female connector portion 14 of the present invention shown in FIG. 7. As illustrated in FIG. 10, the groundplane terminal strip connector 32 is positioned so that the lower cantilevered contacts 60 are in electrical mating connection with a ground contact pad 62 of the motherboard. The upper cantilevered contacts are positioned to be in contact with the groundplane contact pad 41 of the flexible circuit in the male connector portion 12. Also illustrated in FIG. 10 are the forty signal contacts along one side of the connector module receptacle 28.

With respect to the electrical connector assembly 10 shown in FIGS. 1 and 2, traditional spring-type contacts 30 have been selected for the signal contacts since they provide reliable electrical connection without the problems of providing a row of closely aligned, planar contact arrangements. Furthermore, the electrical connector assembly of the present invention may include an elastomeric contact instead of the groundplane terminal strip connector 32 for connecting the groundplane of the flexible circuit 20 to the ground terminal 8 of the motherboard 4. An elastomeric contact may be used for the ground connection since the groundplane electrical path is usually less critical to system performance than the signal contacts.

The electrical connector assembly of the present invention is a modular connector that can stack end-to-end and side-to-side for very high linear density (I/O count per unit length) and area density (I/O count per unit printed circuit board footprint area). The electrical connector system of the present invention provides low skew, easily tailored characteristic impedance and fewer pieces to assemble. Furthermore, the connector assembly uses traditional spring-retention contacts for greater signal reliability, fewer series electrical connections for better reliability and no need for external clamping of the two mating connector halves. Additionally, the artwork for the signal trace of the flexible circuit may be modified to provide a first mate, last break arrangement or sequential solder attachment to a printed circuit board on multi-level applications. The characteristic impedance of the electrical connector assembly may be closely controlled by controlling the width of the electrical trace on the flexible circuit and the distance of the electrical trace from the groundplane. Furthermore, since the electrical connector assembly includes a plurality of individual modules, each module may include a flexible circuit specifically designed for the characteristic impedance of the circuit in which it is to be used. Accordingly, cross-talk is kept to a minimum even with a high density of signal traces connecting the mother and daughterboards. Furthermore, since the flexible circuit generally forms the entire connector, impedance control of the connector assembly is possible throughout the entire connector. Since the impedance of the connector assembly is strictly controlled by the flexible circuit, a relatively simple change of a flexible circuit changes the characteristic impedance of the connector assembly without the need for changing the manufacturing process or tooling of the connector assembly. To further enhance the performance of the connector assembly, the signal contacts 30 are preferably gold-plated.

As previously mentioned, many motherboards and daughterboards use mixed logic such as ECL, TTL, and/or CMOS. Each of these chip sets perform best at different target characteristic impedances. With the connector system of the present invention, which is designed with modular connector portions, different modules can be assembled with different characteristic impedances to match a specific logic section of the printed circuit board. Furthermore, the groundplane terminal strip connector of the connector assembly carries the groundplane between the two rows of signal contacts 30 in each of the module connector receptacles 28. This provides a very good electrical path for the groundplane thus allowing a high density of signal contacts to be utilized in the connector assembly.

Figure 11:
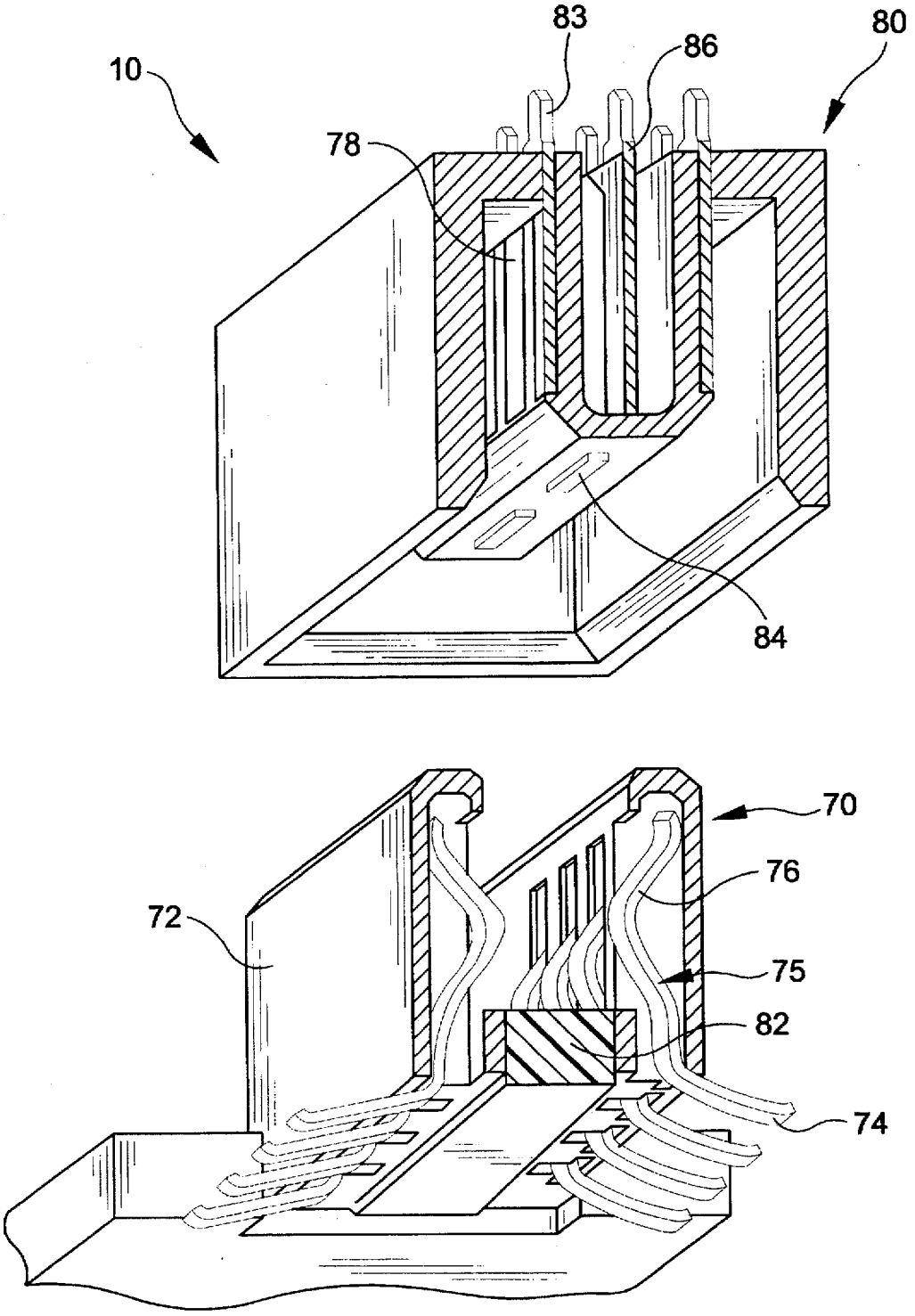
FIG. 11 is a perspective exploded cross-sectional view of an alternative embodiment of the electrical connector assembly, formed in accordance with the present invention.

FIG. 11 illustrates an alternative embodiment of the present invention which provides a variable controlled impedance, high density electrical connector. FIG. 11 shows one module of a connector assembly shown in an exploded cross-sectional perspective view. The module of the connector assembly includes a female connector portion 70 and a male connector portion 80. The female connector portion 70 includes a plurality of spring contacts 75, often called gull wing or J-lead type, for surface mounting the female connector portion to a printed motherboard. The contacts 75 are arranged in the modular housing 72 having a first end 74 for connecting to the printed motherboard and a bent second end 76 for electrically coupling to signal contacts 78 forming a part of the male connector portion 80. The connector module as shown in FIG. 11 includes an elastomeric groundplane connector 82 for connecting a ground contact pad 62 on the motherboard to the groundplane contacts 84 of the male connector portion 80. Furthermore, it is envisioned that the connector assembly illustrated in FIG. 11 may include a flexible circuit jumper coupled to the male connector portion 80 solder tail pins 83 for connection to the daughtercard.

The male connector portion 80 of the connector assembly shown in FIG. 11 includes a series of signal contacts 78 provided on a substantially U-shaped insulator. A groundplane 86 is provided between the legs of the U-shaped housing. The groundplane 86 may be thin, as shown in FIG. 11, for high characteristic impedance. Thus, the space between the groundplane and the legs of the U-shaped housing is separated by air (K=1) to achieve the highest possible impedance for the size. Alternatively, the groundplane may be surrounded with some low dielectric material, such as polyethylene foam (K=1.8–3.0), for greater stability of the dielectric value in different atmospheric conditions. Furthermore, the groundplane may be surrounded by full density plastic (K=3.1–5.0) to trim the characteristic impedance to a target value with a closer tolerance. The groundplane may also be made of a thicker material to achieve a low characteristic impedance. Such thicker groundplanes can be solid metal alloy strip, metal foil around a dielectric, vacuum metalized dielectric, electroless plated dielectric, printed circuit board material with two-sided copper or diecast pieces having the desired dimensions for the target impedance value. Additionally, thickness changes down the length of the groundplane can tailor a different characteristic impedance value for only a few of the connector signal contacts within the same connector module. Alternatively, the connector assembly may include more than one connector module wherein each module can have a specific characteristic impedance designed therein.

Different types of thicker groundplanes can offer performance, design flexibility or cost advantages. Solid metal strip groundplanes could be prototype machined to quickly evaluate performance optimization. Additionally, high volume manufactured groundplane strips can be inexpensively stamped with specific size and thickness tolerances so that the impedance can be closely controlled to plus or minus 0.0003 inches in the rolling process. Furthermore, solid "mu metal" (metal having low initial magnetic permeability) groundplanes could alter low frequency magnetic fields and electric fields, or magnetic ferrite groundplanes could provide inductive filtering effects to soften edge rates to reduce EMI emissions. The "mu metals" are commercially available under the tradenames Supermalloy, Permalloy and Hymu 80. Additionally, plated plastic could be cost effective in high volume manufacturing and provide system performance that is more independent of frequency since the DC cross-sectional area could be close to the high frequency skin-effect depth. Lastly, diecast solid cores could be cost effectively manufactured in high volume applications.

Figure 12:
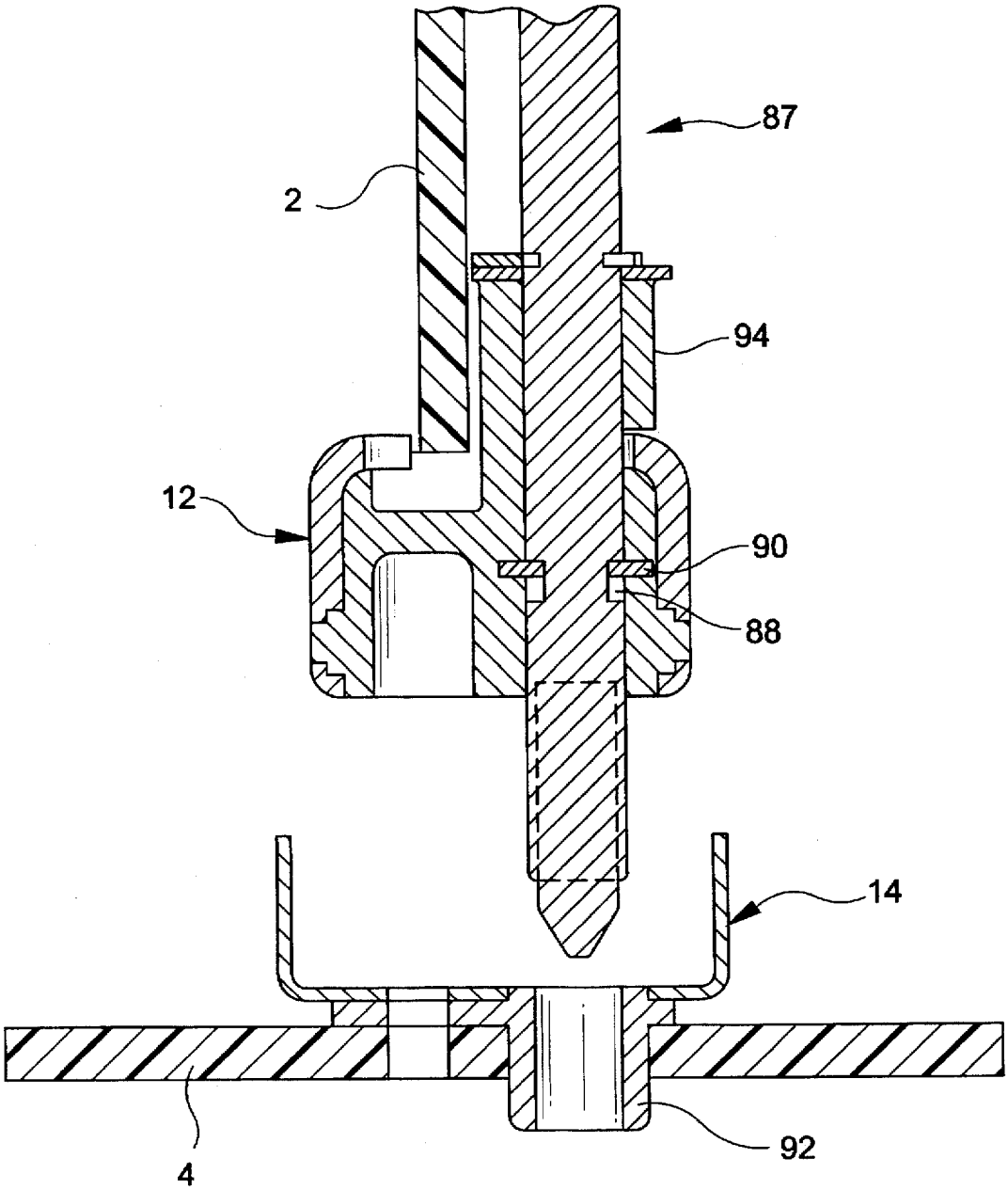
FIG. 12 is a cross-sectional view of an improved jackscrew assembly for use with the electrical connector assembly formed in accordance with the present invention.
Figure 13:
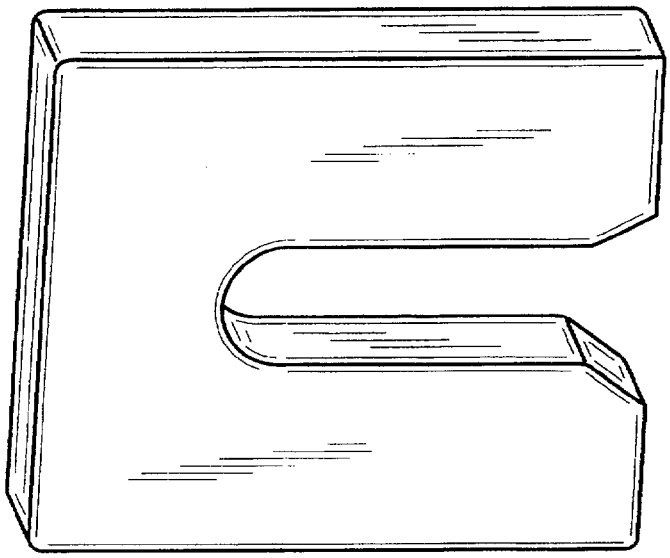
FIG. 13 is a top plan view of the jackscrew retainer clip formed in accordance with the present invention.

FIG. 12 is a cross-sectional view of an improved jackscrew for mechanically mating the male connector portion 12 to the female connector portion 14 of the connector assembly of the present invention. The improved jackscrew 87 includes a slot 88 formed therein having a jackscrew retainer clip 90 which rides within the slot. The retainer clip 90 as shown in FIG. 13 is substantially U-shaped as opposed to a traditional E-clip. The jackscrew retainer clip 90 is positioned within a plastic boss slot 88 by the outside frame. The width and height of the jackscrew retainer clip can be smaller for a given shaft diameter and axial force capability than the traditional snap ring or E-clip. Furthermore, the jackscrew retainer clip of the present invention is captured in the jackscrew assembly so that it cannot fall off and damage other components either electrically or mechanically. As shown in FIG. 12, the female connector portion 14 includes a jackscrew receiver 92 which extends through an aperture in the motherboard 4. The jackscrew assembly is housed in a jackscrew module housing 94 having a thrust washer at an upper portion of the module housing 94.

A controlled impedance, high-density electrical connector of the present invention provides manufacturing ease and a good electrical path for signal transmission even with a high density of signal contacts. In the preferred embodiment, the unique flexible circuit directly electrically connects a daughterboard to a motherboard and can closely control the characteristic impedance of the connector. Additionally, since the connector assembly is modular in design, a different characteristic impedance for each of the modular portions of the connector assembly may be utilized.

Although embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. An electrical connector for connecting a daughterboard to a motherboard, comprising:

a base member, the base member including a plurality of electrical signal contacts, each of the electrical contacts including a termination end for electrically coupling the base to the motherboard and a connecting end; and a plug assembly including a dielectric insulator body and at least one flexible circuit, the at least one flexible circuit having an electrical trace thereon, the electrical trace including first contact portions for electrical engagement with the connection end of the base electrical contacts and second contact portions for electrical engagement with the daughterboard, the first and second contact portions being electrically coupled by the electrical trace, the flexible circuit being bent around the dielectric insulator body so that the contact portions of the electrical trace can be electrically coupled to a surface of the daughterboard, the flexible circuit further including a groundplane portion separated from the electrical trace by a predetermined distance to control a characteristic impedance of the flexible circuit, the groundplane being connectable to a system ground on the motherboard, the plug assembly further including at least two connector modules, each module including a flexible circuit, and wherein the daughterboard is double-sided and the flexible circuit for each of the at least two modules is coupled to opposite single-sides of the daughterboard, and wherein the plug assembly is mechanically connectable to the base member to electrically connect the daughterboard to the motherboard.

2. An electrical connector as defined in claim 1, wherein the connecting end of the electrical signal contacts of the base are spring-retention contacts.

3. An electrical connector as defined in claim 1, wherein the flexible circuit is coupled to a single side of the daughterboard.

4. An electrical connector as defined in claim 1, wherein the plug assembly includes a plurality of modules, each module including a flexible circuit positioned therein.

5. An electrical connector as defined in claim 1, wherein each flexible circuit has a characteristic impedance to match a circuit on the daughterboard to a circuit on the motherboard.

6. An electrical connector as defined in claim 1, wherein a plurality of flexible circuits are coupled to a single side of the daughterboard.

7. An electrical connector as defined in claim 1, wherein at least one of the electrical signal contacts are gold plated.

8. An electrical connector as defined in claim 1, wherein the base member includes at least two rows of electrical signal contacts and further wherein the groundplane is positioned at least in part between the at least two rows of electrical contacts.

9. An electrical connector as defined in claim 8, wherein the flexible circuit includes a first side and second side and the characteristic impedance of the flexible circuit may be varied from the first side to the second side by varying the predetermined distance along the flexible circuit.

10. An electrical connector as defined in claim 1, wherein the flexible circuit comprises a laminate having the groundplane at a bottom surface, an dielectric base provided above the groundplane, and the electrical trace being formed on a top surface of the dielectric base.

11. An electrical connector as defined in claim 10, wherein the groundplane extends through the dielectric base to the top surface of the flexible circuit by through-hole plating to form a groundplane contact pad con the same side of the flexible circuit as the electrical trace.

12. An electrical connector for connecting a daughterboard to a motherboard, comprising:

a base member, the base member including a plurality of electrical signal contacts, each of the electrical contacts including a termination end for electrically coupling the base to the motherboard and a connecting end,; and a plug assembly including at least one flexible circuit, the at least one flexible circuit having an electrical trace thereon, the electrical trace including first contact portions for electrical engagement with the connection end of the base electrical contacts and second contact portions electrical engagement with the daughterboard, the first and second contact portions being electrically coupled by the electrical trace, the flexible circuit further including a groundplane portion separated from the electrical trace by a predetermined distance to control a characteristic impedance of the flexible circuit, the groundplane being connectable to the system ground on the motherboard, and further wherein the base member further includes an elongate ground plane terminal strip connector having at least one upper cantilevered contact for electrically coupling to the groundplane of the flexible circuit and at least one lower cantilevered contact for electrically coupling to a ground terminal on the motherboard, the plug assembly being mechanically connectable to the base member to electrically connect the daughterboard to the motherboard.

13. An electrical connector assembly comprising:

a female connector portion, the female connector portion including a frame and at least one modular receptacle mounted within the frame, the modular receptacle including at least two rows of electrical signal contacts, each of the signal contacts including a connection end and a termination end for electrically coupling the signal contact to a first signal source/receiver; and a male connector portion, the male connector portion including a header assembly having at least one modular male connector housed therein, the male connector including a flexible circuit, the flexible circuit having a groundplane, an electrical trace and an insulator separating the groundplane and electrical trace by a predetermined distance, the electrical trace including first contact portions for electrical engagement with the connection end of said signal contacts and second contact portions for electrical engagement with a second signal source/receiver, the first and second contact portions being electrically coupled by the electrical trace, the modular male connector including a paddle-like body, the flexible circuit being bent around the paddle-like body thereby providing the first contact portions on opposite sides of the paddle-like body for electrical communication with the at least two rows of electrical signal contacts, the groundplane of the flexible circuit being electrically coupled to a ground terminal of both the first and, second signal sources/receivers when the male connector portion is mechanically coupled to the female connector portion.

14. An electrical connector assembly as defined in claim 13, wherein the groundplane extends between and separates the at least two rows of signal contacts.

15. An electrical connector assembly as defined in claim 13, wherein the paddle-like body is made from a dielectric material.

16. An electrical connector assembly as defined in claim 13, wherein the flexible circuit induces a first side and second side and the characteristic impedance of the flex circuit may be varied from the first side to the second side by varying the predetermined distance along the flexible circuit.

17. An electrical connector assembly as defined in claim 13, wherein the flexible circuit comprises a laminate having the groundplane at a bottom surface, a dielectric base provided above of the groundplane, and the electrical trace being formed on a top surface of the dielectric base.

18. An electrical connector assembly as defined in claim 13, wherein the first and second signal sources/receivers are a motherboard and daughterboard, respectively.

19. An electrical connector assembly as defined in claim 18, wherein the first contact portions of the electrical trace are electrically coupled to a single side of the daughterboard.

20. An electrical connector assembly as defined in claim 18, wherein the female connector portion includes at least two modular receptacles and the male connector portion includes at least two male modular connectors, the daughterboard is double-sided and the flexible circuit associated with a first male module connector is electrically coupled to a first side of the daughterboard, and the flexible circuit associated with the at least second male module connector is electrically coupled to a second opposite side of the daughterboard.

21. An electrical connector assembly as defined in claim 13, wherein the female connector portion includes a plurality of modular receptacles and the male connector portion includes a similar plurality of male modular connectors.

22. An electrical connector assembly as defined in claim 21, wherein each male modular connector includes a flexible circuit having a specific characteristic impedance associated therewith to match two circuit impedances coupled by the connector assembly, the characteristic impedance of the flexible circuit being determined by the width of the predetermined distance separating the groundplane and electrical trace and the width of each electrical trace coupling the first and second contact portions.

23. An electrical connector assembly as defined in claim 13, wherein the female connector portion includes an elongate groundplane terminal strip connector positioned between the at least two rows of electrical signal contacts for electrically coupling a ground contact pad from the first signal source/receiver to the groundplane of the flexible circuit.

24. A electrical connector assembly as defined in claim 23, wherein the elongate groundplane terminal strip connector includes at least one upper cantilevered contact for electrically coupling to the groundplane of the flexible circuit and at least one farther cantilevered contact for electrically coupling to a ground contact pad of the first signal source/receiver.

25. An electrical connector assembly as defined in claim 13, wherein the assembly further includes a jackscrew arrangement for mechanically connecting the male connector portion to the female connector portion.

26. An electrical connector assembly as defined in claim 25, wherein the jackscrew assembly includes a jackscrew having a slot formed therein, and a substantially U-shaped clip which rides in said slot.

* * * * *

UNITED STATES PATENT AND TRADEMARK OFFICE

CERTIFICATE OF CORRECTION

PATENT NO. : 5,895,278

DATED : July 21, 1999

INVENTOR(S) : David T. Humphrey

It is certified that error appears in the above-identified patent and that said Letters Patent is hereby corrected as shown below:

| | |
|---|---|
| Column 5, line 46, | "assembly,formed" should be --assembly formed--. |
| Column 13, line 12, | "contact pad con" should be --contact pad on--. |
| Column 13, line 24, | "portions electrical" should be --portions for electrical--.. |
| Column 13, line 29, | "being connectable to the system" should be --being connectable to a system--. |
| Column 13, line 65, | "first and," should be --first and--. |
| Column 14, line 56, | "farther" should be--further--. |

Signed and Sealed this

Fourteenth Day of December, 1999

*Attest:*

Q. TODD DICKINSON

*Attesting Officer*

*Acting Commissioner of Patents and Trademarks*